US008662954B2

(12) United States Patent
Goff et al.

(10) Patent No.: US 8,662,954 B2
(45) **Date of Patent: *Mar. 4, 2014**

(54) TOY DOLL FOR IMAGE CAPTURE AND DISPLAY

(75) Inventors: Christopher L. Goff, Redondo Beach, CA (US); Tracy L. Curreri, Redondo Beach, CA (US); Paul T. King, Newbury Park, CA (US); Wai K. Chan, Kowloon (HK); Chi W. Chan, New Territories (HK); Eric E. Skifstrom, Manhattan Beach, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/485,861

(22) Filed: May 31, 2012

(65) Prior Publication Data

US 2012/0315820 A1 Dec. 13, 2012

Related U.S. Application Data

(63) Continuation-in-part of application No. 12/771,879, filed on Apr. 30, 2010, now Pat. No. 8,506,343.

(60) Provisional application No. 61/529,220, filed on Aug. 30, 2011.

(51) Int. Cl.
*A63H 30/00* (2006.01)

(52) U.S. Cl.
USPC ..... 446/175; 446/268; 446/484; 396/479

(58) Field of Classification Search
USPC ..... 446/175, 268, 484, 297; 369/429
See application file for complete search history.

(56) References Cited

U.S. PATENT DOCUMENTS

| | | | |
|---|---|---|---|
| 1,260,133 | A | 3/1918 | Birdswell |
| 3,507,570 | A | 4/1970 | De Fels et al. |
| 3,973,840 | A | 8/1976 | Jacobs et al. |
| 4,104,625 | A | 8/1978 | Bristow et al. |
| 4,157,633 | A | 6/1979 | Reiner et al. |

(Continued)

FOREIGN PATENT DOCUMENTS

| | | |
|---|---|---|
| FR | 2703205 | 9/1994 |
| WO | 89/04708 | 6/1989 |

OTHER PUBLICATIONS

Bradford, K.T.; "Video Girl Barbie Will Turn Your Kid into a Director"; Feb. 15, 2010; 2 sheets PDF; (http://blog.laptopmag.com/video-girl-barbie-will-turn-your-kid-into-a-director).

*Primary Examiner* — William Brewster
*Assistant Examiner* — Alex F. R. P. Rada, II
(74) *Attorney, Agent, or Firm* — Kolisch Hartwell, PC

(57) ABSTRACT

A toy doll is provided having a torso defined by a front surface and a back surface. The doll may additionally include legs extending from a lower portion of the torso, an image sensor located on the back surface of the torso, and an image display located on the front surface of the torso. The doll may additionally include a control panel integrated into the pelvic region of the torso, operatively interconnected with the image sensor and the image display, so that that the image sensor and the image display are controllable by using the control panel. The doll may further include fabric clothing covering the image display, permitting a user to create the appearance of personalized graphic clothing for the doll.

21 Claims, 6 Drawing Sheets

(56) References Cited

U.S. PATENT DOCUMENTS

| | | | | |
|---|---|---|---|---|
| D270,839 | S | 10/1983 | Greif | |
| 4,486,774 | A | 12/1984 | Maloomian | |
| 4,736,220 | A | 4/1988 | Heinzelmann | |
| 4,802,879 | A | 2/1989 | Rissman et al. | |
| 4,813,905 | A | 3/1989 | Yamaguchi et al. | |
| 4,819,076 | A | 4/1989 | Briggs | |
| 4,864,333 | A | 9/1989 | Barber | |
| 4,878,873 | A | 11/1989 | Yamaguchi et al. | |
| 4,978,216 | A | 12/1990 | Liljegren et al. | |
| 4,982,281 | A | 1/1991 | Gutierrez | |
| 5,111,290 | A | 5/1992 | Gutierrez | |
| 5,118,319 | A | 6/1992 | Smith et al. | |
| 5,289,273 | A | 2/1994 | Lang | |
| 5,382,187 | A | 1/1995 | Wilson | |
| 5,439,407 | A | 8/1995 | Friedel | |
| 5,545,072 | A | 8/1996 | Arad et al. | |
| 5,549,499 | A * | 8/1996 | Foskey et al. | 446/268 |
| 5,738,526 | A | 4/1998 | Cerda et al. | |
| 5,991,547 | A | 11/1999 | Baiera et al. | |
| 6,064,421 | A | 5/2000 | Pohl | |
| 6,159,101 | A | 12/2000 | Simpson | |
| 6,171,171 | B1 | 1/2001 | Barthold | |
| 6,264,379 | B1 | 7/2001 | Rydelek et al. | |
| 6,264,521 | B1 | 7/2001 | Hernandez | |
| 6,435,934 | B1 | 8/2002 | Bender | |
| 6,467,908 | B1 | 10/2002 | Mines et al. | |
| 6,535,793 | B2 | 3/2003 | Allard | |
| 6,547,624 | B1 | 4/2003 | Bojesen et al. | |
| 6,554,679 | B1 | 4/2003 | Shackelford et al. | |
| 6,558,224 | B2 | 5/2003 | Chan | |
| 6,558,225 | B1 | 5/2003 | Rehkemper et al. | |
| 6,568,983 | B1 | 5/2003 | Peters | |
| 6,746,304 | B1 | 6/2004 | Liu | |
| 6,802,757 | B1 | 10/2004 | Sejnowski | |
| 6,997,773 | B1 | 2/2006 | Dubois et al. | |
| 7,062,073 | B1 | 6/2006 | Tumey et al. | |
| 7,086,770 | B2 | 8/2006 | Tell et al. | |
| 7,248,170 | B2 | 7/2007 | DeOme et al. | |
| 7,447,564 | B2 | 11/2008 | Yasukawa et al. | |
| 7,611,396 | B2 | 11/2009 | Schnuckle | |
| 7,992,331 | B2 | 8/2011 | Schnuckle | |
| 2001/0004577 | A1 | 6/2001 | Lewis | |
| 2002/0111117 | A1 | 8/2002 | Ho et al. | |
| 2003/0016286 | A1 | 1/2003 | Liu et al. | |
| 2006/0293102 | A1 | 12/2006 | Kelsey | |
| 2007/0046774 | A1 | 3/2007 | Silva et al. | |
| 2007/0065142 | A1 | 3/2007 | Liang | |
| 2007/0128979 | A1 | 6/2007 | Shackelford et al. | |
| 2007/0159779 | A1 * | 7/2007 | Chang | 361/683 |
| 2008/0176481 | A1 | 7/2008 | Zebersky | |
| 2008/0252726 | A1 | 10/2008 | Chan et al. | |
| 2008/0287033 | A1 | 11/2008 | Steinberg | |
| 2009/0137185 | A1 | 5/2009 | Zheng | |
| 2009/0197504 | A1 | 8/2009 | Hsu | |
| 2009/0209170 | A1 | 8/2009 | Richter | |
| 2009/0305600 | A1 | 12/2009 | Roesch | |
| 2010/0115683 | A1 * | 5/2010 | Krans et al. | 2/115 |
| 2010/0197195 | A1 | 8/2010 | Andersen | |
| 2012/0075424 | A1 * | 3/2012 | Kawamoto et al. | 348/46 |
| 2012/0295510 | A1 * | 11/2012 | Boeckle | 446/72 |

* cited by examiner

TOY DOLL FOR IMAGE CAPTURE AND DISPLAY

CROSS-REFERENCE TO RELATED APPLICATIONS

The present application is a continuation-in-part under 35 U.S.C. §120 of U.S. patent application Ser. No. 12/771,879, entitled INTERACTIVE TOY DOLL FOR IMAGE CAPTURE AND DISPLAY, filed on Apr. 30, 2010; and additionally claims the benefit of the filing date under 35 U.S.C. §119(e) of U.S. Provisional Patent Application Ser. No. 61/529,220, entitled TOY DOLL WITH INTEGRAL CAMERA AND CONTOURED IMAGE DISPLAY, filed on Aug. 30, 2011; both of which are hereby incorporated by reference in their entirety for all purposes.

FIELD OF THE DISCLOSURE

The present disclosure relates generally to toys for image capture and display and, more particularly, to toy dolls with an integral camera and image display.

BACKGROUND OF THE DISCLOSURE

Children enjoy a variety of toy action figures and dolls that can be manipulated to simulate real life activities. Often these dolls allow children to simulate activities the children are not yet able to participate in themselves.

One way of increasing the enjoyment of these activities and available play options is to provide dolls that are capable of capturing and displaying images of these simulated real life activities. Examples of toys/devices for capturing and displaying a still or video image are found in U.S. Pat. Nos. 1,260,133, 3,053,144, 3,507,570, 3,973,840, 3,973,840, 4,104,625, 4,157,633, 4,486,774, 4,802,879, 4,813,905, 4,878,873, 4,978,216, 4,982,281, 5,118,319, 5,289,273, 5,382,187, 5,439,407, 5,545,072, 6,159,101, 6,171,171, 6,264,521, 6,371,825, 6,435,934, 6,467,908, 6,547,624, 6,558,224, 6,558,225, 6,746,304, 7,008,288, 7,248,170, 7,611,396, 7,857,454, 7,992,331; and in U.S. Publication Nos. US20030016286, US20040092207, US20060293102, US20080176481, US20080287033, US20090137185, US20090197504, US20090305600, US20100197195; and in published patent application Nos. FR2703205, GB2039680, GB2328292, GB2328292, GB555420, JP56080039, WO9106891, WO9311523, and WO9908259. The disclosures of these and all other publications referenced herein are incorporated by reference in their entirety for all purposes.

SUMMARY OF THE DISCLOSURE

In one example, a toy doll for image capture and display is provided having a torso defined by a front surface and a back surface. The doll may additionally include legs extending from a lower portion of the torso, an image sensor located on the back surface of the torso, and an image display located on the front surface of the torso. The doll may additionally include a control panel integrated into the pelvic region of the torso, operatively interconnected with the image sensor and the image display, so that the image sensor and the image display are controllable by using the control panel. The doll may further include a processor operatively connected to the image sensor and the image display.

In another example, a toy doll for image capture and display is provided having a torso defined by a front torso portion and a back torso portion, legs extending from a lower portion of the torso, an image sensor located on the back portion of the torso, an image display located on the front portion of the torso, and a processor operatively connected to the image sensor and the image display.

Various methods of playing with a toy doll having a torso and legs, an image sensor disposed on a back surface of the torso, an image display disposed on a front surface of the torso, and a control input disposed on a lower front portion of the torso may include grasping the legs while leaving the image sensor and the image display exposed, activating a manual power control, so that images created by the image sensor are displayed on the image display, positioning the toy doll to orient the image sensor toward a desired image subject, framing the desired image subject within the image display, and activating a manual capture control, so that the framed image is captured as an electronic image data file.

DETAILED DESCRIPTION OF THE DISCLOSURE

The toy dolls of the present invention may provide users with new opportunities for play by combining a traditional toy doll with an integrated camera and image display. The toy doll may be used to capture images of another user, other toys or toy dolls in play, and/or simulated real life activities such as photography, fashion design, and modeling, among others. The user may display the captured images on the doll, or through the doll's clothing, such as a T-shirt. In this manner, the doll may be used to simulate T-shirt customization from the perspective of the user. One or more image frames or stamps, including still graphics or animations, may be incorporated with the captured image on the doll. In addition, the user may upload their favorite images from the toy doll to a computer, and optionally use software to edit the images for further personalizing or customizing of the images. These special images may then be shared with others using the Internet or other network, for example by using social networking services. Alternatively, images on the computer originating from other sources may be transferred from the computer for display on the doll.

Figure 1:
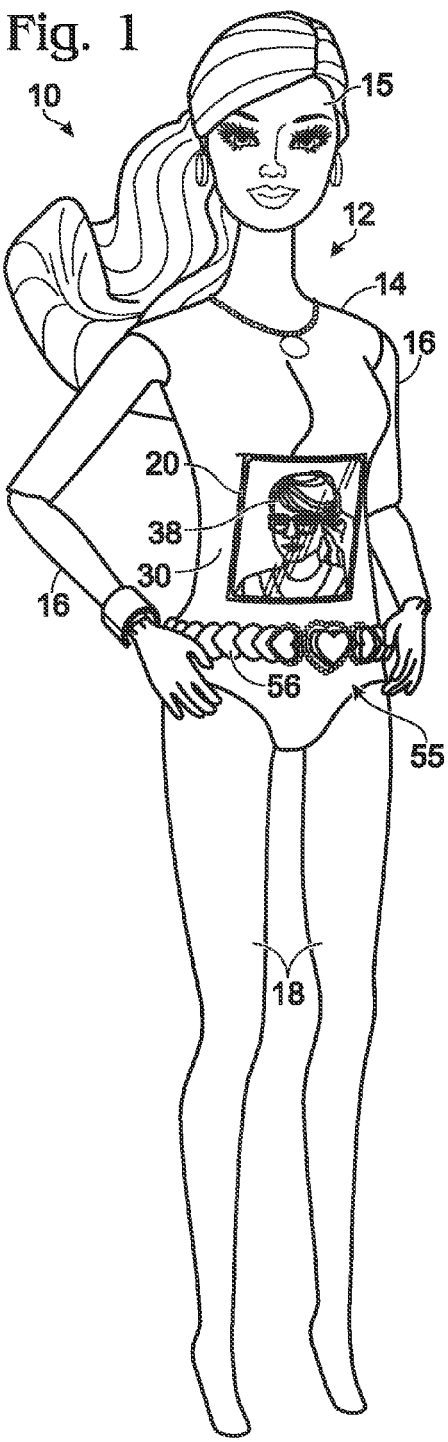
FIG. 1 is a front perspective view of a toy doll according to an exemplary embodiment of the present invention.
Figure 3:
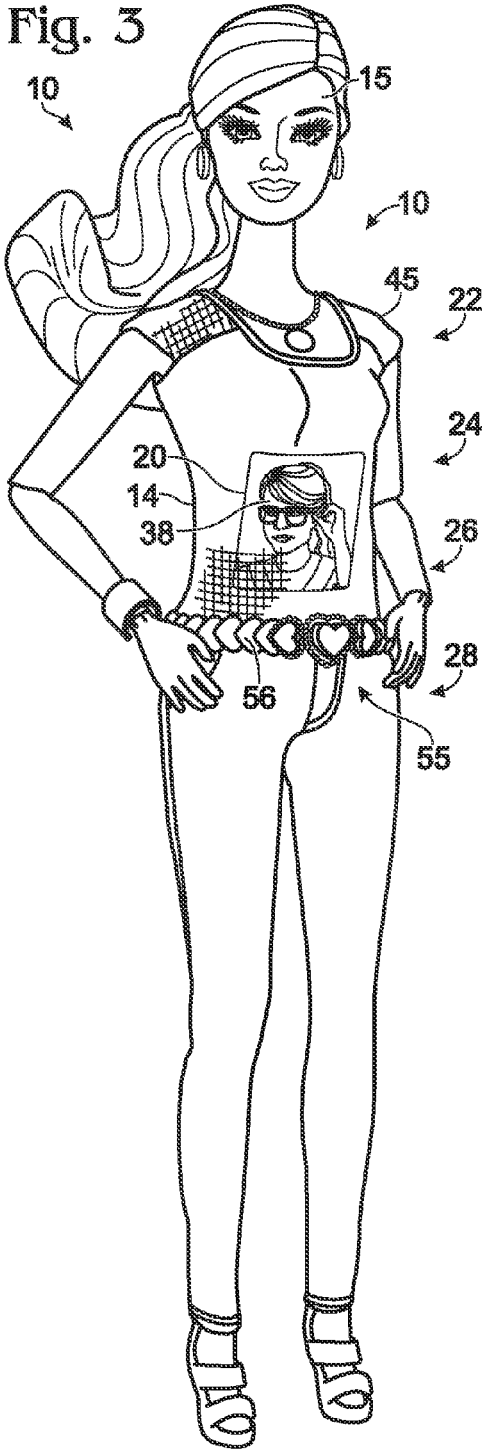
FIG. 3 is a front elevation view of the toy doll of FIG. 1, wearing toy clothing.
Figure 2:
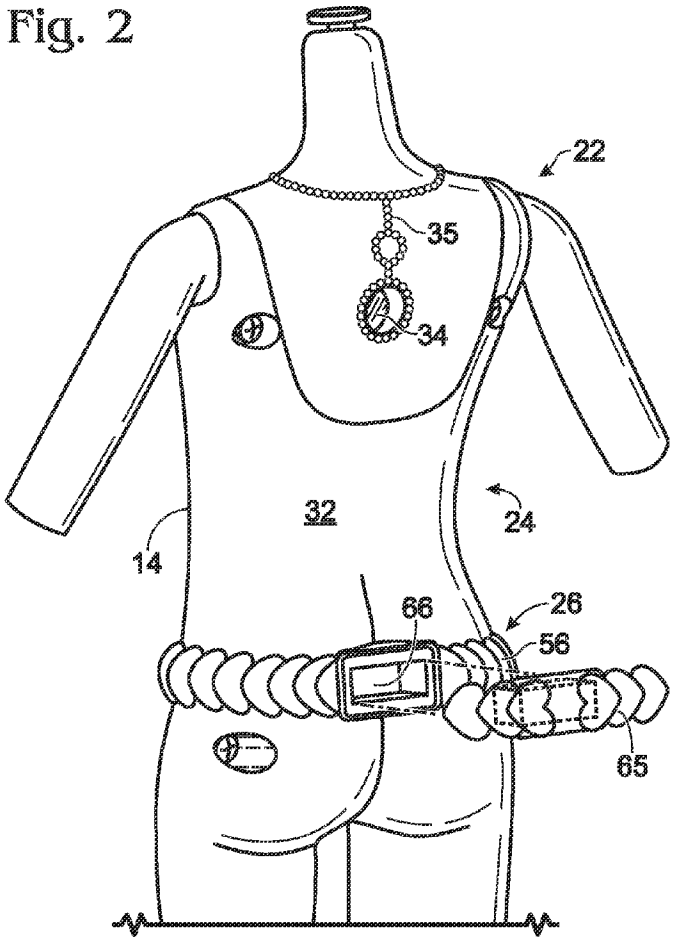
FIG. 2 is a partial rear perspective view of the toy doll of FIG. 1.

FIGS. 1, 2, and 3 depict a toy doll 10 according to the present invention. Toy doll 10 has a body 12 that includes a torso 14, head 15, arms 16, and legs 18. Doll 10 includes an image display 20 that is incorporated in the torso 14 of the doll. The image display 20 may be disposed on a front side of the torso 14. In the illustrated example, the display 20 is disposed upon the torso between a clavicle area and a navel area on the torso.

As shown in FIGS. 2 and 3, torso 14 may include an upper portion 22, a middle portion 24, and a lower portion 26. Upper portion 22 may generally include and correspond to the shoulders, upper chest, and/or thoracic region of the doll. Middle portion 24 may include and/or correspond to the abdominal region of the doll. The lower portion 26 may include and/or correspond to a lumbar region or pelvic region 28. Torso 14 may be defined by one or more shell portions, for example a front shell 30 and a back shell 32 that, when combined, form torso 14.

Image display 20 may be incorporated into the front shell 30 of torso 14, for example in the middle portion 24, or the abdominal region of the doll. Image display 20 may be substantially planar, or have a curved or partially curved surface. Alternatively or in addition, the image display 20 may be contoured to more closely resemble the front surface of a torso, such as by including an area contoured to resemble breasts (for a female doll), or an area contoured to resemble musculature (for a male doll). Image display 20 may include a screen element that is translucent, transparent, and/or clear. Where the image display 20 includes a screen element that is semi-translucent, the screen element may include a panel with a matte white finish, also referred to as frosted finish, and/or may be configured so as to resemble a white t-shirt being worn by the toy doll 10.

Figure 9:
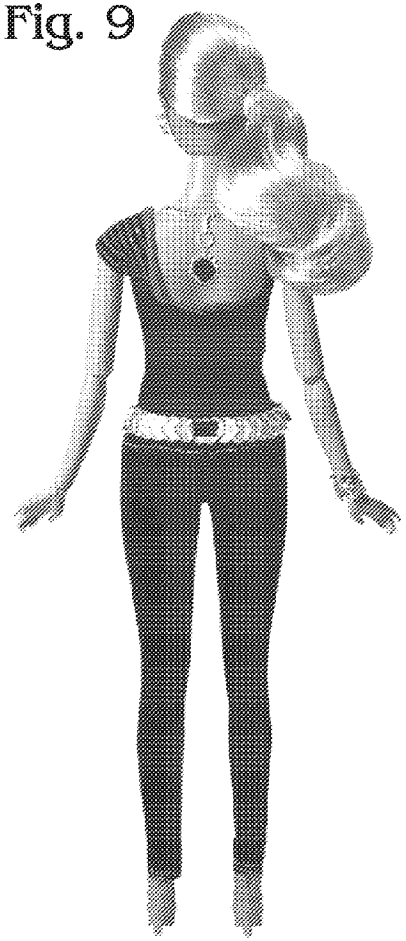
FIG. 9 includes a color image of the back of a toy doll according to an exemplary embodiment of the invention.
Figure 10:
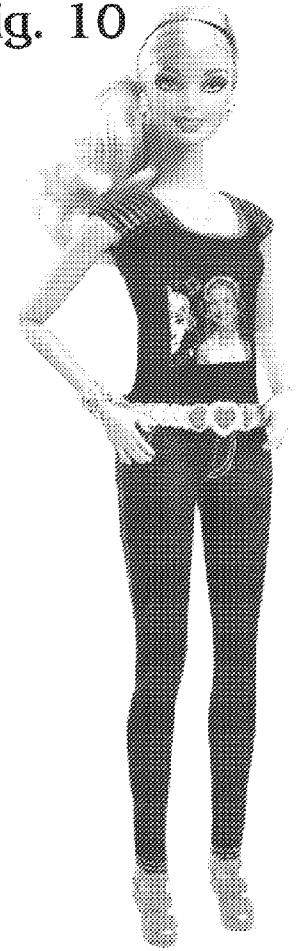
FIG. 10 includes a color image of the front of the toy doll of FIG. 9, showing fabric clothing covering the image display.

Alternatively, or in addition, a suitable piece of clothing or fabric may be disposed over the image display 20. For example as shown in FIGS. 3, 9, and 10, toy doll 10 may be clothed in a T-shirt 45. Where T-shirt 45 is a black T-shirt, the image 38 on image display 20 may make the T-shirt 45 appear to be a graphic T-shirt, with the graphic taken from image 38. In the preferred embodiment, the shirt is made of black semi-transparent fabric. This fabric appears to be opaque on most portions of the doll, but acts as a semi-transparent scrim over the image display 20. The combination of image display 20 and semi-transparent, fabric clothing covering image display 20 permits the user to create the appearance of personalized graphic shirts for toy doll 10 featuring, for example, the faces of friends or family members, images of pets, images of other toy dolls, etc.

Referring to FIG. 2, toy doll 10 may further include a camera lens 34. Doll 10 may be configured to capture an image through camera lens 34 and display the captured image on image display 20. Alternatively or in addition, image display 20 may be used as a view finder is used with a traditional camera, permitting the user to frame the image they wish to capture by viewing the image prior to capturing the image. Camera lens 34 may be integrated into a back area of torso 14, and in particular may be integrated into the upper back of torso 14. In addition, the upper back region of torso 14 may incorporate ornamentation, such as a depiction of a necklace 35, to at least partially camouflage and/or disguise the presence of camera lens 34.

Figure 6:
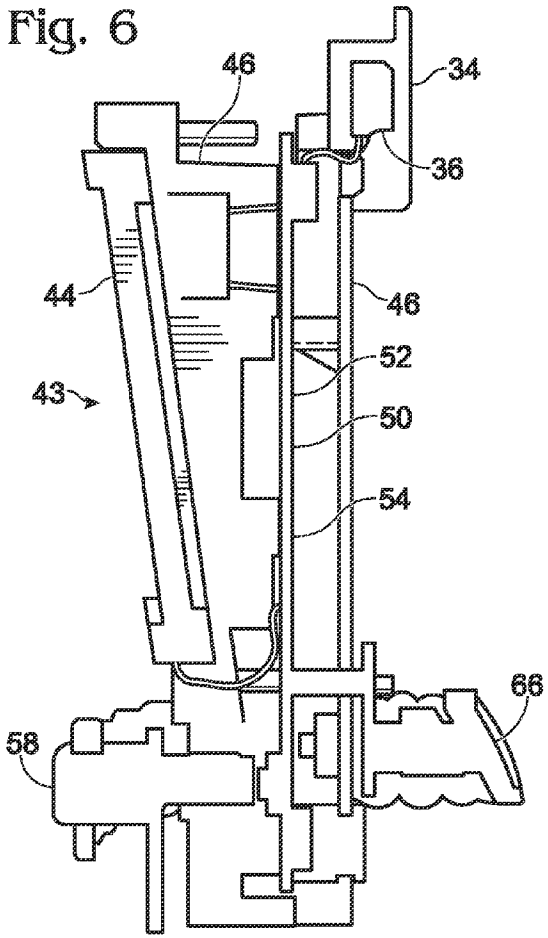
FIG. 6 is a side cross-sectional view of the internal electronics of the toy doll of FIG. 1.

The toy doll 10 may further include an image sensor 36 that is typically optically coupled to camera lens 34, as shown in FIG. 6. The image sensor may be any sensor that is configured to electronically sense an image and convert the sensed image into electronic data. Image sensor 36 may include a web camera, a real time camera, a digital still photo camera and/or any other image capturing device known to those skilled in the art. In one embodiment, the image sensor 36 includes a charge coupled device (CCD). In another embodiment, image sensor 36 may include a 640×480 Video Graphics Array (VGA). In yet another embodiment, the image sensor 36 includes a complementary metal-oxide-semiconductor (CMOS) sensor, such as a GC0307 sensor from GALAXY CORE INC in Shanghai, China. Any of a variety of additional types of image sensors, with higher or lower resolution, may be used when appropriate.

The display of a desired image 38 on the translucent or transparent image display 20 may be accomplished via a display engine 43. Any mechanism that may be configured to display a desired image on image display 20 is a suitable display engine for the purposes of this disclosure. The display engine may include an LCD (Liquid Crystal Display) engine, a DLP (Digital Light Processing) engine having one or more chips, or an OLED (Organic Light Emitting Diode) engine, among others.

In one embodiment, the display engine 43 includes a projection display engine that is configured to "project" the desired image onto an interior surface 40 of image display 20. "Projection" of the image 38 on interior surface 40 renders the image visible on an exterior surface 42 of the image display 20. In some embodiments where the component of the doll with the interior surface 40 and the exterior surface 42 is transparent (such as illustrated in FIGS. 1 and 3-5), the image 38 is directly visible from the exterior surface 42. The image projected onto image display 20 may include a moving or video image or a still image. Typically, the image 38 is a still image.

Figure 4:
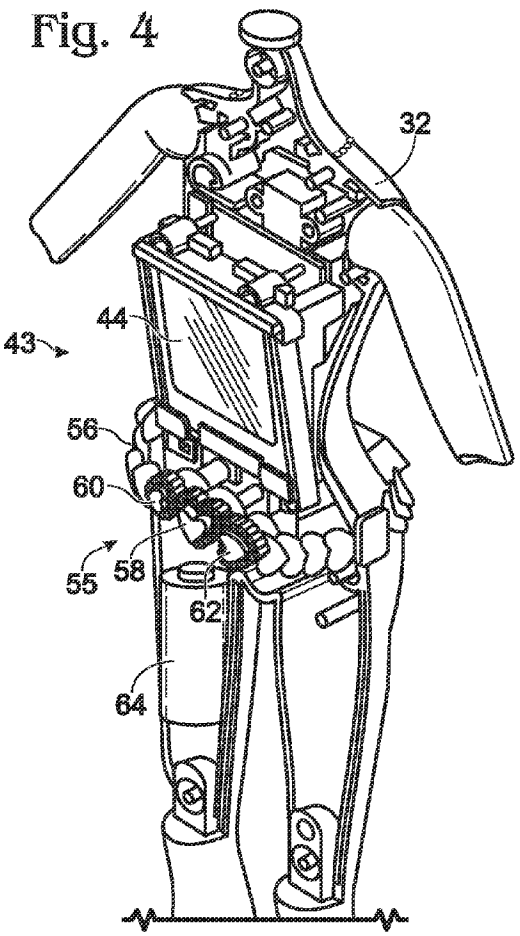
FIG. 4 is a partial front perspective cut-away view of the toy doll of FIG. 1.
Figure 5:
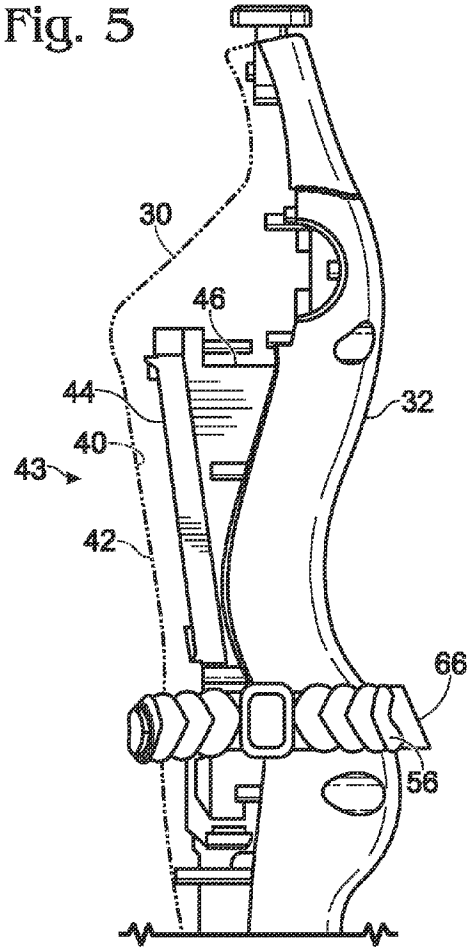
FIG. 5 is a partial side elevation cut-away view of the toy doll of FIG. 1.

More typically, and with reference to FIGS. 4-6, display engine 43 incorporates an LCD screen 44, which may also be referred to as LCD glass. LCD screen 44 may be housed within torso 14, inside the cavity created by the front shell 30 and the back shell 32 when combined. The display engine 43 including LCD screen 44 may be secured and/or stabilized by one or more retaining brackets 46.

The display engine 43 and the image sensor 36 are typically both operatively connected to a printed circuit board assembly 50 (PCBA) via a printed wiring assembly, or via additional wiring. The printed circuit board assembly 50 may further include a processor 52, and a memory 54 associated with processor 52.

Processor 52 may be configured to process the electronic data corresponding to the images sensed by the image sensor 36, and then storing the captured image in memory 54. Either processor 52 or printed circuit board assembly 48 may optionally be capable of carrying out data compression on either raw image data or post-processing image files, thereby permitting additional images to be saved in memory 54. Processor 52 and image memory 54 are typically housed within torso 14, typically in close proximity to display engine 43. The processor 52 may additionally be configured with various pre- or post-processing effects or filters to apply to a captured image. For example, a sepia-tone processing may be selected by a user prior to image capture and displayed during image capture, such that the stored image includes the sepia-tone processing.

Memory 54 of toy doll 10 may optionally be provided with a variety of preloaded images, such as images of the character of toy doll 10, associated characters representing other toy dolls, a selection of clip art, such as picture borders or text, additional graphics, or animations which may be added to a captured image by the user. In alternative embodiments, the preloaded images may be selected prior to the image capture. For example, a picture border may be pre-selected and displayed during the image capture so that the user may properly align the subject of the image within the picture border. Additionally or alternatively, an animation may be selected prior to image capture and displayed during image capture, such that the animation or a reference to the animation may be stored with the captured image.

The toy doll 10 may include one or more additional interfaces capable of serving as access points for auxiliary memory devices. Auxiliary memory devices are available in a variety of formats, but in one embodiment of the invention, the additional interface is configured as a card slot for a memory card. Among the various types of memory cards, microSD-format memory cards are relatively small, and therefore may be particularly convenient when used in conjunction with toy doll 10.

Figure 11:
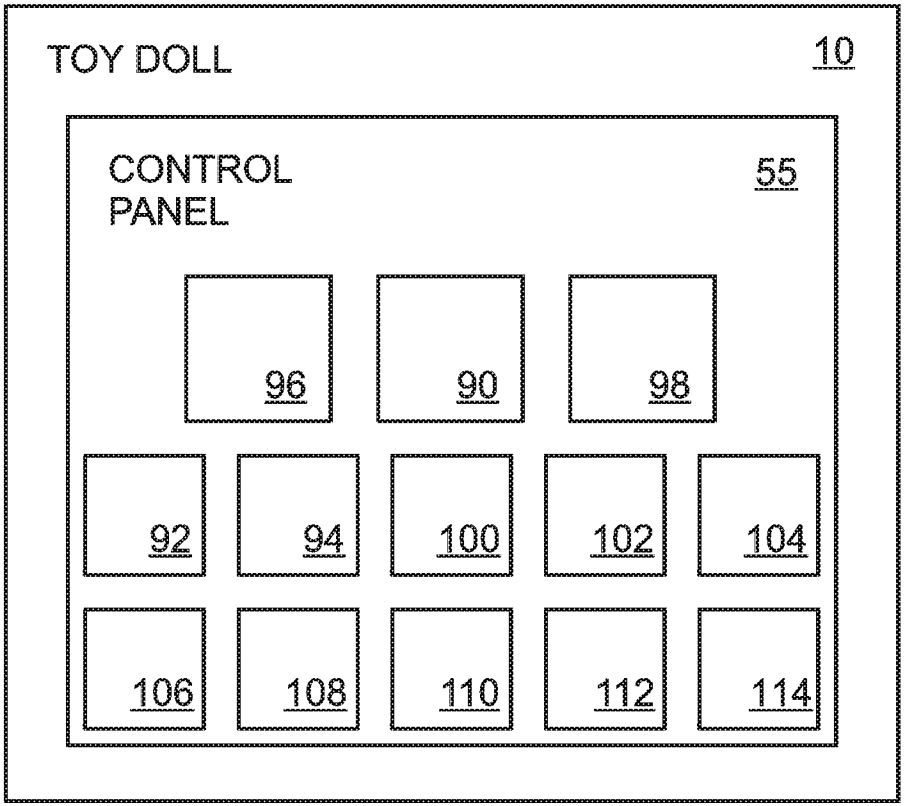
FIG. 11 is a schematic showing a control panel for a toy doll according to an exemplary embodiment of the invention.

In some embodiments of toy doll 10, the doll may further include a control panel 55 having one or more manual inputs, as depicted schematically in FIG. 11. Selected manual inputs may include a power button 90, a photo capture button 92, a photo delete button 94, a scroll left button 96, a scroll right button 98, a trash button 100, a record button 102, a play button 104, a zoom button 106, a moving button 108, a panning button 110 a reset button 112, and a button 114 configured to modify an image displayed on the image display 20 by superimposing images selected from the image memory 54, among others. Toy doll 10 may include a switch or button configured to toggle between an image capture mode and an image edit mode. The manual inputs may also be used to select a pre-loaded image or a processing effect or filter. In some embodiments, the manual inputs change function based on context, such as the state of the doll or the previous inputs from a user.

As shown in FIGS. 1, 3, and 5, toy doll 10 may include a control panel 55 that includes multiple manual inputs disposed upon the lower torso 26, where the control panel 55 is configured to resemble a belt 56. The manual inputs of doll 10 may include a combined power and photo capture button 58, a scroll left button 60, and a scroll right button 62, for example.

Power button 58 may be depressed to activate the toy doll 10, while subsequent presses of button 58 may trigger the capture of an image via camera lens 34 and image sensor 36, and to save the captured image as an electronic image data file in memory 54.

The left and right scroll buttons may then be used by the user to navigate between multiple images stored in memory 54. For example, after powering on doll 10, a user may press right scroll button 62 to access and view a stored and/or captured image file on image display 20. By pressing right scroll button 62 again, a second stored image file may be displayed. Alternatively, pressing left scroll button 60 may return to a previously displayed image.

A user may press, hold, and release button 58 to power-off doll 10. Alternatively or in addition, toy doll 10 may be configured to power-down and turn off independently after a predetermined period of inactivity. Furthermore, the doll 10 may include a "slideshow mode", where the doll 10 displays some or all the images stored on the doll, in sequence, with a push of the button 58.

During operation, image display 20 may provide a user with visual representations to communicate functions that may be performed or are being performed. For example, image display 20 may display a low battery, low memory, and/or delete memory graphic during operation. In some embodiments, additionally and/or alternatively, doll 10 may include a LED that may flash different flashing patterns if an interactive toy doll has either low memory or low battery power. Moreover, before an image is viewed image display 20 may display a unique file name associated with each image to indicate which image is being viewed/played.

As shown in FIG. 4, toy doll 10 may further include a power source 64 configured to power the image sensor, processor, memory, and display engine of the doll, among other possible components. Power source 64 may include one or more batteries, including disposable/replaceable batters, rechargeable batteries, or sealed batteries configured to be charged via an external power source, such as a power cable or powered data cable. Power source 64 may be housed in one or both of legs 18 of toy doll 10.

In another embodiment, the toy doll 10 may include an electrical connector 66 configured to receive a data and/or power cable 68. Electrical connector 66 may be integrated into lower torso 26, and configured to be operatively connected to processor 52. For example, as shown in FIG. 4, the electrical connector 66 may be incorporated into the decorative belt design 56. Electrical connector 64 may have any suitable interface format, such as a mini-USB socket, mini-HDMI socket, mini-DVI socket or similar interface. Electrical connector 66 may take the form of an exposed socket, or the socket may be capped or covered when not in use, for example by a removable gasket or other cap 65.

The electrical connector may be configured to be capable of performing such functions as 1) outputting image data or stored data files from memory 54 to an associated computer 71, a TV, or a similar audio and/or visual device; 2) inputting additional image or other data files onto memory 54; 3) inputting a software and/or firmware update to toy doll 10; or 4) charging power source 64.

Figure 7:
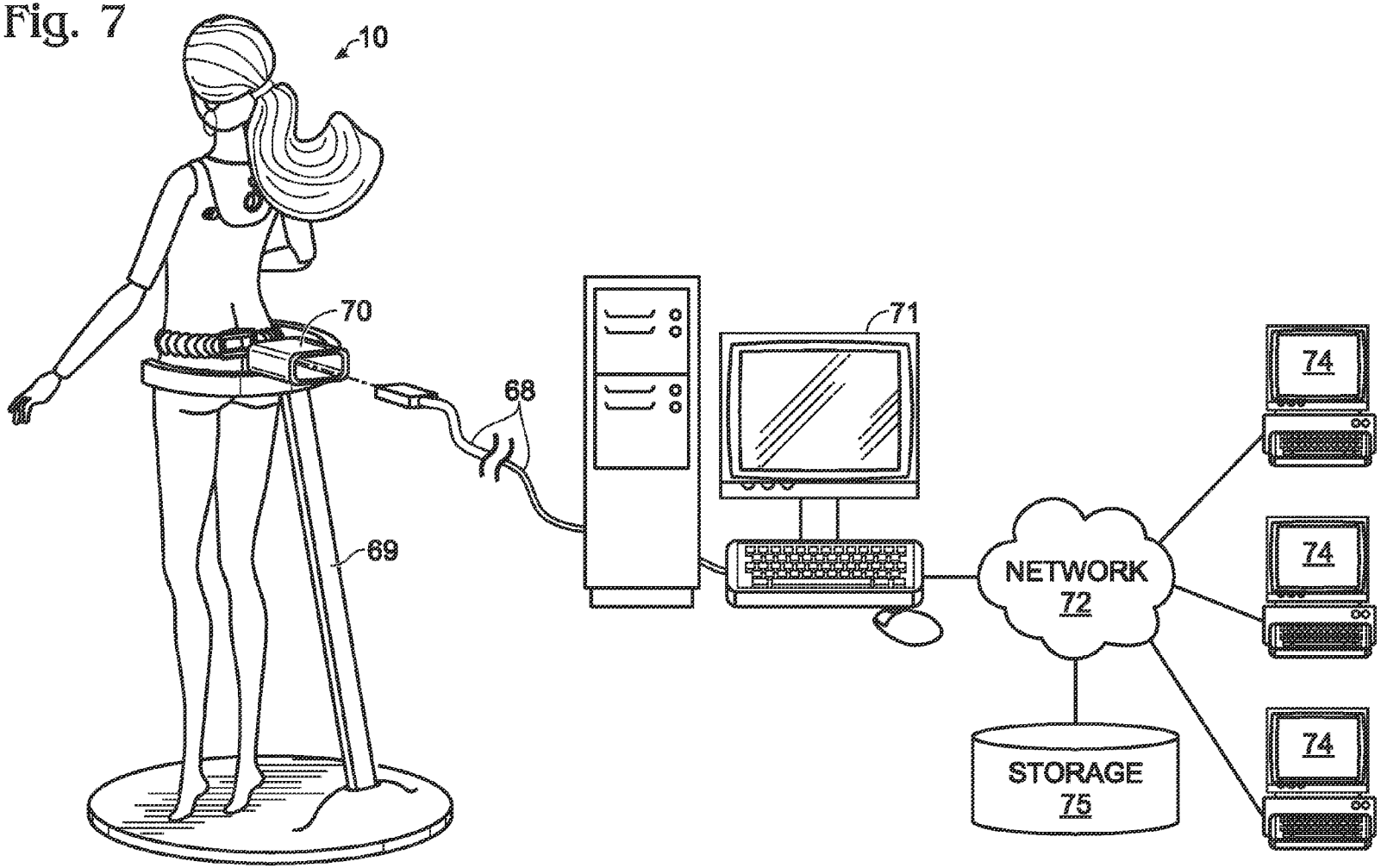
FIG. 7 is a schematic showing a toy doll according to an exemplary embodiment of the invention secured in a display stand and connected via a data cable to a computer that is in turn connected to a network.

As shown in FIG. 7, toy doll 10 is being displayed in a display stand 69. In addition to providing support for the toy doll in an upright position, display stand 69 may also include a cable support 70 that is configured to accommodate and/or support data/power cable 68, in order to facilitate the connection of the toy doll with an associated computer 71.

By connecting toy doll 10 to a computer via electrical connector 66 and data/power cable 68, the user may be permitted to edit captured images using software located on any or all of memory 54 inside doll 10, memory inside computer 71, a CD-ROM (or similar data storage device) or on an associated network 72 such as the Internet. In some embodiments, however, toy doll 10 may include software and/or additional manual inputs to allow editing without a computer. This may allow a user to view and edit an image directly after capturing the image or pre-select filters or graphics to add to the image prior to capturing the image.

Editing software may permit the manipulation of several aspects of the captured images. Using filters, a user may be able to filter captured image files by, for example, warping, applying black and white filters, and/or applying sepia tone filters. Using graphics, a user may be able to drop in thought bubbles, popping hearts, and other graphical elements. After editing is complete, a user may share image files with other users, either directly or via the network 72 and other networked computers 74. In one aspect, the user may share image files using one or more online social networks or communities. Where the user shares images on network 72, those images may be stored at one or more data storage locations 75 that are also connected to network 72.

As depicted herein, legs 18 and torso 14 (and therefore image display 20 and camera lens 34) are fixed relative to one another. However, it is common for the torso and legs of toy dolls to be connected by a joint, such as a swivel joint or ball joint, with additional joints at various locations on the arms and legs of the doll. Other embodiments of the toy dolls of the present invention may present a different overall appearance and/or shape, or may differ in one or more structural details.

Figure 8:
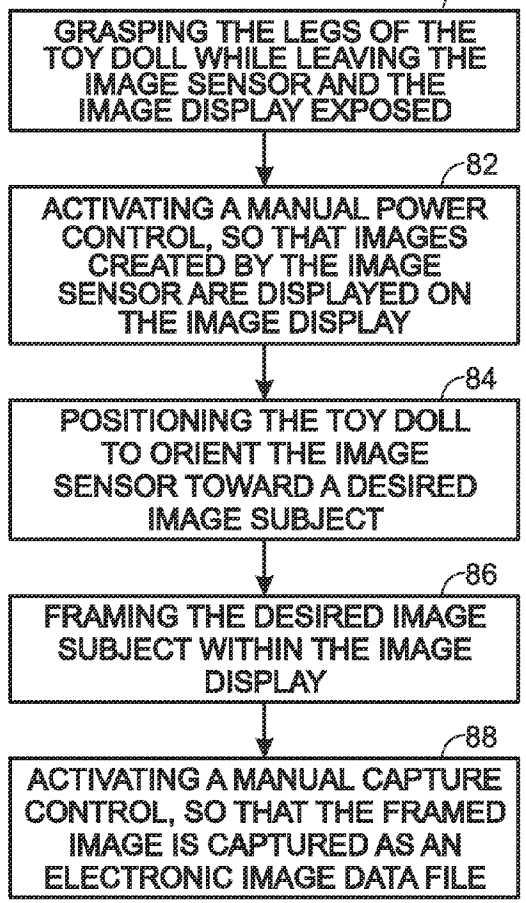
FIG. 8 is a flowchart setting out a method of playing with a toy doll, according to an exemplary embodiment of the present invention.

The toy dolls of the present invention lend themselves to new and innovative modes of play. Given a toy doll of the present invention that includes a torso and legs, an image sensor disposed on a back surface of the torso, an image display disposed on a front surface of the torso, and a control input disposed on a lower front portion of the torso, the toy doll may be used in a method of play as set out in flowchart 76 of FIG. 8. As shown, flowchart 76 includes grasping the legs while leaving the image sensor and the image display exposed at 78; activating a manual power control, so that images created by the image sensor are displayed on the image display at 80; positioning the toy doll to orient the image sensor toward a desired image subject at 82, framing the desired image subject within the image display at 84, and activating a manual capture control, so that the framed image is captured as an electronic image data file at 86.

As the legs 18 of toy doll 10 may be grasped by a user while leaving image sensor 36 and image display 20 exposed, a user may easily view the image display as if using a viewfinder before capturing an image, as well as using the image display to then view the captured image, all while grasping legs 18.

Color images of the back and front of a representative toy doll according to an embodiment of the present invention are shown in FIGS. 9 and 10, respectively. The toy doll of FIGS. 9 and 10 incorporates many of the features disclosed herein, including the display of a captured image, particularly where the captured image has been edited by the addition of preloaded graphics. Additionally, the display of the captured image through the black T-shirt worn by the doll gives the appearance that the image is a personalized graphic printed on the front of the T-shirt.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the disclosure includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

We claim:

1. A toy doll comprising:

a torso, defined by a front torso surface and a back torso surface, and including a pelvic region;

a camera lens integrated into the back torso surface;

an image sensor supported inside the torso and optically connected to the camera lens;

an image display integrated into the front torso surface and operatively connected to the image sensor;

a control panel integrated into the pelvic region of the torso, operatively interconnected with the image sensor and the image display, such that the image sensor and the image display are controllable by using the control panel.

2. The toy doll of claim 1, further including a processor operatively connected to the image sensor and the image display.

3. The toy doll of claim 2, further including fabric clothing covering the image display.

4. The toy doll of claim 2, further including an electrical connector integrated into the torso and operatively connected to the processor.

5. The toy doll of claim 2, further including a power source operatively connected to the processor.

6. The toy doll of claim 1, further including legs extending from a lower portion of the torso; and a processor operatively connected to the image sensor and the image display, the processor configured to capture an image sensed by the image sensor and display the sensed image on the image display.

7. The toy doll of claim 6, further including an image memory operatively connected to the processor.

8. The toy doll of claim 7, wherein the control panel includes at least one manual input.

9. The toy doll of claim 8, where the control panel includes a manual input for capturing an image sensed by the image sensor, saving the captured image to the image memory, and displaying the captured image on the image display.

10. The toy doll of claim 8, where the control panel includes a manual input for selecting an image saved in the image memory, and displaying the selected image on the image display.

11. The toy doll of claim 8, where the control panel includes a manual input for modifying an image displayed on the image display by superimposing images selected from the image memory.

12. The toy doll of claim 8, where the control panel is configured to resemble a belt worn by the toy doll.

13. The toy doll of claim 6, further comprising a shirt worn by the toy doll, where the shirt does not substantially interfere with a display of an image by the image display.

14. The toy doll of claim 6, further including an electrical connector integrated into the torso and operatively connected to the processor.

15. The toy doll of claim 6, further including a power source housed in at least one of the legs and operatively connected to the processor.

16. The toy doll of claim 14, further comprising a stand configured to display the toy doll in an upright position, and to support a data cable that is coupled to the electrical connector of the toy doll.

17. A method of playing with a toy doll, where the toy doll includes a torso and legs, an image sensor disposed on a back surface of the torso, an image display disposed on a front surface of the torso; and a control input disposed on a lower front portion of the torso; the method comprising:

grasping the legs while leaving the image sensor and the image display exposed;

activating a manual power control, so that images created by the image sensor are displayed on the image display;

positioning the toy doll to orient the image sensor toward a desired image subject;

framing the desired image subject within the image display; and activating a manual capture control, so that the framed image is captured as an electronic image data file.

18. The method of playing with a toy doll of claim 17, further comprising outputting the electronic image data file to an associated computer.

19. The method of playing with a toy doll of claim 18, wherein outputting the electronic image data file to an associated computer includes coupling the toy doll to the computer using a data cable.

20. The method of playing with a toy doll of claim 18, wherein outputting the electronic electronic image data file to an associated computer makes the electronic image data file available for editing using the associated computer.

21. The method of playing with a toy doll of claim 18, further comprising uploading the electronic image data file to a website.

* * * * *